US011066949B2

(12) United States Patent
Mairhanser et al.

(10) Patent No.: US 11,066,949 B2
(45) Date of Patent: Jul. 20, 2021

(54) GUIDE VANE RING ELEMENT FOR A TURBOMACHINE

(71) Applicant: MTU Aero Engines AG, Munich (DE)

(72) Inventors: Vitalis Mairhanser, Sigmertshausen (DE); Birgit Effner, Dachau (DE); Alexander Halcoussis, Haimhausen (DE); Hannes Wolf, Mammendorf (DE)

(73) Assignee: MTU Aero Engines AG, Munich (DE)

( * ) Notice: Subject to any disclaimer, the term of this patent is extended or adjusted under 35 U.S.C. 154(b) by 823 days.

(21) Appl. No.: 15/223,262

(22) Filed: Jul. 29, 2016

(65) Prior Publication Data

US 2017/0037741 A1 Feb. 9, 2017

(30) Foreign Application Priority Data

Aug. 3, 2015 (EP) ..... 15179449

(51) Int. Cl.
*F01D 17/16* (2006.01)
*F01D 9/04* (2006.01)
*F04D 29/56* (2006.01)

(52) U.S. Cl.
CPC ..... *F01D 17/162* (2013.01); *F01D 9/041* (2013.01); *F04D 29/563* (2013.01); *F05D 2220/323* (2013.01); *F05D 2230/10* (2013.01); *F05D 2240/12* (2013.01); *F05D 2240/129* (2013.01); *F05D 2240/80* (2013.01)

(58) Field of Classification Search
CPC ..... F01D 17/16; F01D 17/162; F01D 9/02; F01D 9/04; F01D 9/041; F01D 9/042; F04D 29/54; F04D 29/541; F04D 29/542; F04D 29/56; F04D 29/563; F05D 2240/12; F05D 2240/129; F05D 2240/80
See application file for complete search history.

(56) References Cited

U.S. PATENT DOCUMENTS 3,908,430 A * 9/1975 Orain ..... B21J 5/12 72/354.2
6,602,049 B2 * 8/2003 Caubet ..... F01D 5/143 415/160
6,682,299 B2 * 1/2004 Bowen ..... F01D 9/02 384/273
7,802,963 B2 9/2010 Holland et al.
2002/0061249 A1 * 5/2002 Caubet ..... F04D 29/563 415/160
2011/0293406 A1 * 12/2011 Abadie ..... F01D 17/162 415/160

(Continued)

FOREIGN PATENT DOCUMENTS

DE 102013222980 A1 6/2015
EP 2816198 A1 6/2014
FR 2824593 A1 11/2002

*Primary Examiner* — Christopher Verdier
*Assistant Examiner* — Elton K Wong
(74) *Attorney, Agent, or Firm* — Barlow, Josephs & Holmes, Ltd.

(57) ABSTRACT

The present invention relates to a guide vane ring element for a turbomachine, such as a gas turbine, with at least one drilled hole for the at least partial uptake of a flange of a rotatable guide vane, wherein an edge of the drilled hole on the vane element side is designed convexly along the edge in a first circumferential portion and, in particular, has a radius.

9 Claims, 1 Drawing Sheet

(56) References Cited

U.S. PATENT DOCUMENTS

Figure 1:
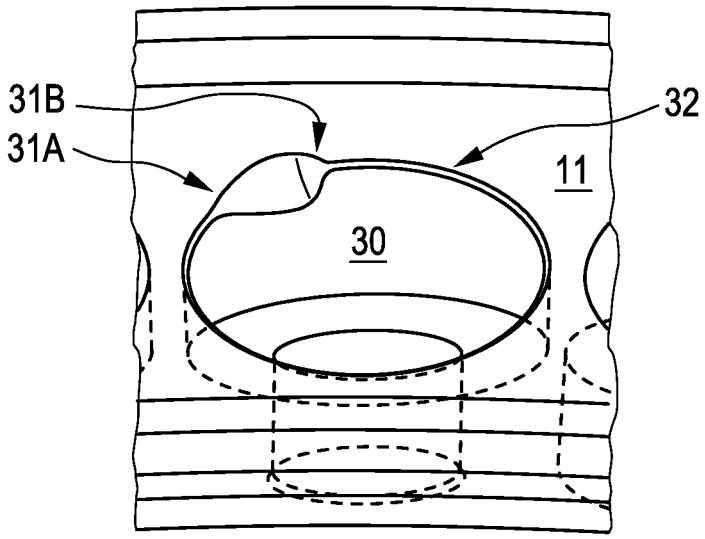

| | | | | |
|---|---|---|---|---|
| 2014/0119894 | A1* | 5/2014 | Hensley | F01D 17/162<br>415/148 |
| 2014/0140822 | A1* | 5/2014 | Capozzi | F01D 9/00<br>415/160 |
| 2016/0003074 | A1* | 1/2016 | Chius | F01D 9/041<br>415/177 |

* cited by examiner

GUIDE VANE RING ELEMENT FOR A TURBOMACHINE

BACKGROUND OF THE INVENTION

The present invention relates to a guide vane ring element for a turbomachine, in particular a gas turbine, a guide vane cascade element with the guide vane ring element, a turbomachine, in particular a gas turbine, with the guide vane cascade element, and a method for manufacturing the guide vane ring element.

Known from US 2011/0293406 A1 is a guide vane ring element with drilled holes for the partial uptake of flanges of rotatable guide vanes. In a circumferential portion of a drilled hole, which the front side of a vane element of the guide vane passes over on the side of the drilled hole, the edge of the drilled hole has a slight bevel because of the expansion of the vane element.

SUMMARY OF THE INVENTION

An object of an embodiment of the present invention is to improve a turbomachine, in particular a gas turbine.

This object is achieved by a guide vane ring element having the features of the present invention. The present invention also provides a guide vane cascade element with a guide vane ring element described here, a turbomachine with a guide vane cascade element described here, and a method for manufacturing a guide vane ring element described here. Advantageous embodiments of the invention are described in detail below.

According to one aspect of the present invention, a turbomachine, in particular a gas turbine, in particular an aircraft engine gas turbine, in particular a compressor of the gas turbine, has one or a plurality of adjustable guide vane cascade elements.

In one embodiment, a guide vane cascade element can be designed in the form of a circle or ring segment, so that a plurality of guide vane cascade elements or segments together form a (closed) guide vane cascade ring, in particular a guide vane cascade, of the turbomachine, in particular a stage, in particular a compressor stage, of the gas turbine, or are provided or designed for this purpose. Similarly, in another embodiment, a guide vane cascade element can be designed in the form of a (full) circle or in the form of a ring and, in an enhancement, can form a (closed) guide vane cascade ring, in particular a guide vane cascade, of the turbomachine, in particular a stage, in particular a compressor stage, of the gas turbine, or can be provided or designed for this purpose.

In one embodiment, a guide vane cascade element has one or a plurality of guide vane ring elements and one or a plurality of adjustable guide vanes.

In one embodiment, a guide vane ring element can be designed in the form of a circle or ring element, so that a plurality of guide vane ring elements or segments together form a (closed) guide vane ring of the turbomachine, in particular of a stage or of the stage, in particular compressor stage, of the gas turbine, or are provided or designed to this purpose. Similarly, in an enhancement, a guide vane ring element can be designed in the form of a (full) circle or in the form of a ring and, in an enhancement, can form a (closed) guide vane ring of the turbomachine, in particular of a stage or of the stage, in particular compressor stage, of the gas turbine, or can be provided or designed for this purpose. Ring segments and full rings are referred to in common as elements herein for more compact presentation.

In one embodiment, the guide vane ring element can be positioned radially inward or radially outward of the guide vanes or can be a (radially) inner or (radially) outer guide vane ring element.

In one embodiment, the guide vanes each have a vane element and a flange, which is particularly in the form of a cylinder and/or a cone, and which is mounted rotatably in full or in part in a drilled hole of the guide vane ring element or one of the guide vane ring elements.

The flange can be positioned on the face side or at a radial end of the guide vane. In other words, the guide vane can terminate with the flange in the radial direction or end in it.

In another embodiment, the guide vane can have an extension or skirt, particularly in the form of a cylinder and/or cone, on the side of the flange that lies radially opposite the vane element. In one embodiment, the maximum diameter thereof is at most 90%, in particular at most 80%, and/or at least 10%, in particular at least 20% of a minimum diameter of the flange. Additionally or alternatively, in an embodiment, the radial height of the extension or skirt is at least 10%, in particular at least 20%, and/or at most 200%, in particular at most 100%, of a radial height of the flange, particularly a minimum radial height of the flange.

In one embodiment, the flange adjoins the vane element of the guide vane radially, in particularly in a fillet.

In particular, the flange can be a (rotating) disc or a (rotating) journal of the rotatable guide vane.

In one embodiment, it has the form of a straight or obliquely truncated cylinder or cone. In one embodiment, it has a bevel or a radius on a side that lies radially opposite the vane element.

Correspondingly, according to one aspect of the present invention, a guide vane ring element or the guide vane ring element for a turbomachine or for the turbomachine, in particular the gas turbine, in particular a guide vane ring element of a turbomachine or of the turbomachine, has one or a plurality of drilled holes, in each of which a flange of a rotatable or adjustable guide vane is mounted rotatably in full or in part (radially) or is or are provided or configured for this purpose.

In one embodiment, the drilled holes are, at least substantially, in the form of a cylinder and/or extend, in particular also or at least substantially, in the radial direction of the turbomachine or perpendicular to its main axis or axis of rotation.

The drilled holes each have an edge that faces a vane element or the vane elements of the guide vanes on the side of the vane element, in which they merge into an outer surface of the guide vane ring element on the vane element side. In other words, an edge of a drilled hole demarcates or defines the orifice thereof to or in the outer surface of the guide vane ring element.

According to one aspect of the present invention, the edge of one or a plurality of the drilled holes is or will be designed (in each case) convexly at least in a first circumferential portion along the edge. In other words, the drilled hole has in each case a convex edge or an edge that is curved toward the guide vane in one or a plurality of (cross) sections along a longitudinal axis of the drilled hole or an axis of the rotation of the guide vane.

In this way, in one embodiment, it is possible, in particular in comparison to a bevel, to reduce advantageously any leakage between the guide vane ring element and the guide vane, in particular of a face of the vane element thereof on the side of the drilled hole or facing the drilled hole. Additionally or alternatively, in one embodiment, it is possible in this way to reduce advantageously any expansion of the edge and thus any disruption of the flow.

In one embodiment, a face or the face of a vane element of a guide vane on the side of the drilled hole lies, in a neutral or intermediate position of the adjustable guide vane, radially opposite the first circumferential portion, in particular the middle thereof in the peripheral direction of the edge. In one embodiment, the first circumferential portion extends over at least 2%, in particular at least 5%, and/or at most 50%, in particular at most 25%, of a length of the edge in the peripheral direction.

In one embodiment, the edge has a radius in the first circumferential portion. In other words, the drilled hole has, in a first circumferential portion of its edge, a rounding or fillet, particularly a fillet that is curved or convex toward the guide vane, in (cross) sections, in particular all (cross) sections, along a or the longitudinal axis or axis of rotation of the guide vane, in each case on its (vane element side) edge, or merges in a radius into the outer surface of the guide vane ring element on the vane element side.

In one embodiment, a radius can be advantageous, particularly in terms of production engineering and/or flow engineering, in particular in terms of leakage.

In one embodiment, the radius is constant in the first circumferential portion or changes by at most 1%. Such a constant radius can be advantageous particularly in terms of production engineering; it can be produced or will be produced, in particular, by a form milling cutter.

In another embodiment, the radius varies in the first circumferential portion along the edge, in particular by at least 10%. Such a varying radius can be especially advantageous, particularly in terms of flow engineering; it can be manufactured or will be manufactured by side milling cutters and/or face milling cutters and/or row by row.

In another embodiment, the radius increases in a first subregion of the first circumferential portion along the edge and decreases in an adjoining, in particular shorter, second subregion of the first circumferential portion along the edge. The first and second subregions can together form the first circumferential portion. Such an asymmetrically varying radius can be especially advantageous particularly in terms of flow engineering; it can be manufactured or will be manufactured, in particular, by side milling cutters and/or face milling cutters.

In one embodiment, the edge is particularly a sharp or blunt edge, a bevel, or a radius, particularly a constant radius, in a second circumferential portion along the edge. The first and second circumferential portions can together form the edge. Similarly, the edge can have, besides the first and second circumferential portions, one or two additional circumferential portions, in which, in one embodiment, it can be an edge or bevel. Correspondingly, in one embodiment, the second circumferential portion extends over at least 50%, in particular at least 75%, of a length or the length of the edge in the peripheral direction.

In one embodiment, a second circumferential portion with a radius can improve, in particular, the manufacture and/or inflow of the first circumferential portion.

In an enhancement, a or the maximum radius in the second circumferential portion can be smaller than a radius, particularly a maximum and/or a minimum radius, in the first circumferential portion; in one embodiment, the maximum radius in the second circumferential portion is at most 50%, in particular at most 25%, of a radius, particularly a maximum and/or a minimum radius, in the first circumferential portion.

In one embodiment, a radius, particularly a maximum or minimum radius, in the first circumferential portion, is at least 1%, in particular at least 2%, in particular at least 5%, in particular at least 10%, and/or at most 50%, in particular at most 30%, in particular at most 10%, of a radius. In one embodiment, additionally or alternatively, a or the radius, particularly a maximum or a minimum radius, in the first circumferential portion, is at least 1%, in particular at least 2%, in particular at least 5%, in particular at least 10%, and/or at most 50%, in particular at most 30%, in particular at most 10%, of a radial depth of the drilled hole at this circumferential position, particularly of the outer surface of the guide vane ring element on the vane element side all the way to a bottom or skirt of the drilled hole.

In one embodiment, the edge will be or is processed and, in particular manufactured, by milling, at least in the first circumferential portion and, in an enhancement, also in the second circumferential portion, in particular by a form milling cutter.

In one embodiment, the drilled hole is a through-hole; in another embodiment, it is a hole closed at one end or a blind hole. In one embodiment, it can be formed in the radial direction without a skirt or it can have one or a plurality of skirts.

In one embodiment, the flange of a guide vane contacts a bottom or skirt of the drilled hole, which accommodates it at least in part, or it rests radially against the bottom or skirt.

The term "radial" refers, in particular, to the turbomachine. Correspondingly, the radial direction is directed perpendicular to a main axis or axis of rotation of the turbomachine.

BRIEF DESCRIPTION OF THE DRAWING FIGURES

Figure 2:
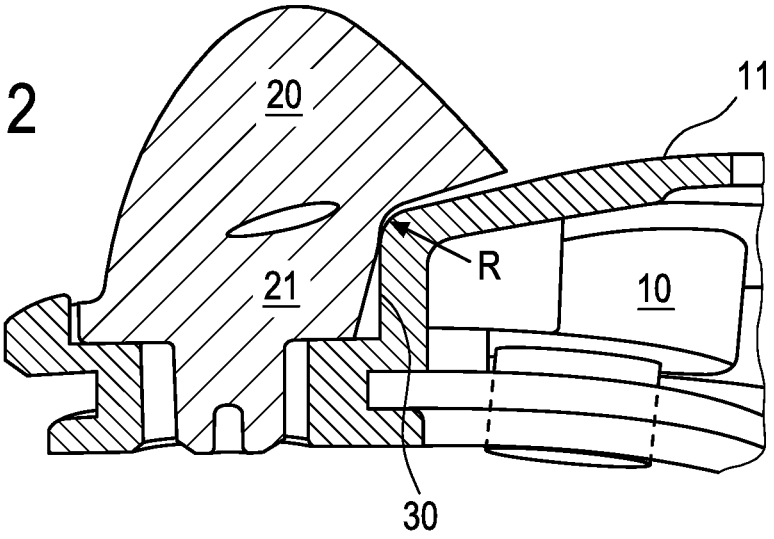
Figure 3:
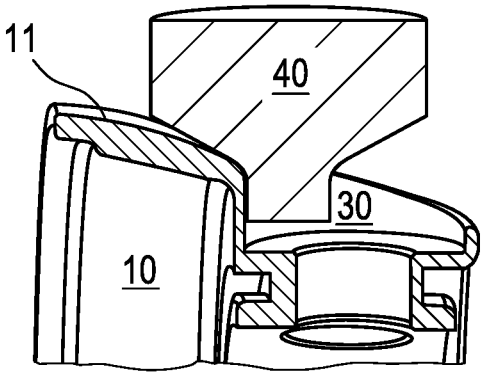

Other advantageous enhancements of the present invention ensue from the dependent claims and the following description of preferred embodiments. Shown partially schematically for this purpose are:

FIG. 1, a perspective view of a portion of a guide vane ring element of a turbomachine according to an embodiment of the present invention;

FIG. 2, a cut through the guide vane ring element with a guide vane along an axis of rotation of the guide vane in a neutral position of the guide vane; and FIG. 3, a cut, corresponding to FIG. 2, during manufacture of the guide vane ring element according to an embodiment of the present invention.

DESCRIPTION OF THE INVENTION

FIG. 1 shows a perspective view of a portion of a radially inner guide vane ring element 10 of a turbomachine according to an embodiment of the present invention. FIG. 2 shows a cut through the guide vane ring element with a guide vane 20 along an axis of rotation of the guide vane (vertically in FIG. 2) in a neutral position of the guide vane.

The guide vane has a flange 21, which is mounted rotatably in a drilled hole 30 of the guide vane ring element.

The drilled hole 30 has an edge on the vane element side, in which it merges into an outer surface 11 of the guide vane ring element on the vane element side. This edge is composed of a first circumferential portion (31A, 31B) and a second circumferential portion 32.

In the neutral or intermediate position of the adjustable guide vane 20 shown in FIG. 2, a face of a vane element of the guide vane lies, on its drilled hole side (in FIG. 2, bottom), radially opposite the middle of the first circumferential portion 31A, 31B in the peripheral direction of the edge.

The edge has a radius R in the first circumferential portion 31A, 31B, which can be seen, in particular, in the cut of FIG. 2.

In the exemplary embodiment, the radius increases in a first subregion 31A of the first circumferential portion along the edge and decreases in an adjoining shorter second subregion 31B of the first circumferential portion along the edge, with the first and second subregions together forming the first circumferential portion 31A, 31B.

In a modification, which appears identically in the cut of FIG. 2, the radius R is constant in the first circumferential portion 31A, 31B.

In the exemplary embodiment, the edge has a constant radius in the second circumferential portion 32 along the edge, which is markedly smaller than a maximum radius in the first circumferential portion 31A, 31B and can therefore not be seen in the schematic cut of FIG. 2. In a modification, the second circumferential portion can also have a sharp or blunt edge or a bevel.

The first circumferential portion 31A, 31B is manufactured by milling using a form milling cutter 40, which is illustrated in FIG. 3.

Although exemplary embodiments were described in the above description, it is noted that a large number of modifications are possible.

In particular, in the exemplary embodiment, the guide vane 20 has an extension or skirt in the form a cylinder on the side of the flange 21 (and thus at the bottom in FIG. 2) lying radially opposite the vane element. In a modification that is not illustrated, the guide vane 20 can also terminate with the flange 21 in the radial direction or ends in it.

The drilled hole 30 in the exemplary embodiment is a through-hole, which has a skirt in the radial direction, on which the flange 21 rests radially. In a modification that is not illustrated, the drilled hole 30 can also be a blind hole.

Both modifications can be combined, so that the flange on the face side then rests radially on the bottom of the blind hole.

Moreover, it is noted that the exemplary embodiments are merely examples, which are not intended to limit the scope of protection, the applications, and the design in any way. The person skilled in the art will instead be afforded a guideline by the above description for the implementation of at least one exemplary embodiment, with it being possible to make diverse changes, in particular with respect to the function and arrangement of the described components, without departing from the protective scope as ensues from the claims and combinations of features equivalent to them.

What is claimed is:

1. A guide vane ring element for a turbomachine, comprising:

a vane ring element defining at least one drilled hole therein;

the at least one drilled hole being configured for the at least partial uptake of a flange of a rotatable guide vane, wherein an edge of the at least one drilled hole on the vane ring element side is designed convexly in a first circumferential portion along the edge, wherein the convexly designed first circumferential portion has an edge that is curved towards the rotatable guide vane, wherein the first circumferential portion is configured and arranged to reduce any leakage between the vane element and the rotatable guide vane, and the rotatable guide vane is partially shaped such that it corresponds to a shape of the first circumferential portion, wherein a radius of the convexly designed first circumferential portion is at least 1% and/or at most 50% of a radius and/or a radial depth of the drilled hole, wherein the radius varies along the edge in the first circumferential portion, and wherein the radius increases along the edge in a first subregion of the first circumferential portion and decreases in an adjoining, shorter, second subregion of the first circumferential portion.

2. The guide vane ring element according to claim 1, wherein the edge has a constant radius along the edge in a second circumferential portion.

3. The guide vane ring element according to claim 2, wherein a maximum radius of the second circumferential portion is smaller than a radius, a maximum or a minimum, of the first circumferential portion.

4. The guide vane ring element according to claim 1, wherein the edge is processed by milling at least in the first circumferential portion, by means of a form milling cutter.

5. The guide vane ring element according to claim 1, wherein the convex edge is formed by a ruled surface.

6. The guide vane ring element according to claim 1, wherein the rotatable guide vane is configured as a guide vane cascade element, wherein the flange of the rotatable guide vane is mounted rotatably at least in part in one of the at least one drilled hole.

7. The guide vane ring element according to claim 6, wherein a face end of the rotatable guide vane on the drilled hole side lies radially opposite the first circumferential portion, substantially in the middle thereof, in a neutral position of the rotatable guide vane.

8. The guide vane ring element according to claim 1, wherein the element is configured and arranged in a turbomachine.

9. The guide vane ring element according to claim 1, wherein the first circumferential portion extends over a portion of the edge in the range of 2%-50%, and wherein a second circumferential portion extends over a remaining portion of the edge.

* * * * *